US006119883A

United States Patent [19]

Hock et al.

[11] Patent Number: 6,119,883

[45] Date of Patent: Sep. 19, 2000

[54] TAMPER-INDICATING CLOSURE AND METHOD OF MANUFACTURE

[75] Inventors: Mark R. Hock, Toledo; Charles A. Webster, Bowling Green; Shawn E. Kellogg, Perrysburg; Paul R. Graham, Holland; Loleta T. Tolliver-Rogers, Perrysburg, all of Ohio

[73] Assignee: Owens-Illinois Closure Inc., Toledo, Ohio

[21] Appl. No.: 09/206,214

[22] Filed: Dec. 7, 1998

[51] Int. Cl.[7] ..... B65D 41/34

[52] U.S. Cl. ..... 215/252; 264/328.1; 53/485

[58] Field of Search ..... 215/252, 256, 215/44; 264/328.1; 53/423, 485, 490, 491

[56] References Cited

U.S. PATENT DOCUMENTS

| | | |
|---|---|---|
| Re. 33,265 | 7/1990 | Gregory et al. . |
| 3,297,184 | 1/1967 | Andelin . |
| 3,329,295 | 7/1967 | Fields . |
| 3,374,913 | 3/1968 | Zipper . |
| 3,438,528 | 4/1969 | Fields . |
| 3,484,012 | 12/1969 | White et al. . |
| 3,784,041 | 1/1974 | Birch . |
| 3,858,743 | 1/1975 | Mumford . |
| 3,861,551 | 1/1975 | Hannon . |
| 4,126,240 | 11/1978 | Brach . |
| 4,147,268 | 4/1979 | Patel et al. . |
| 4,157,144 | 6/1979 | Weiler et al. . |
| 4,196,818 | 4/1980 | Brownbill . |
| 4,206,851 | 6/1980 | Ostrowsky . |
| 4,291,813 | 9/1981 | Allen et al. . |
| 4,305,516 | 12/1981 | Perné et al. . |
| 4,322,009 | 3/1982 | Mumford . |
| 4,394,918 | 7/1983 | Grussen . |
| 4,401,227 | 8/1983 | Pehr . |
| 4,432,461 | 2/1984 | Mumford et al. . |

(List continued on next page.)

FOREIGN PATENT DOCUMENTS

| | | |
|---|---|---|
| 0049876 | 4/1982 | European Pat. Off. . |
| 0801005 | 10/1997 | European Pat. Off. . |
| 2291915 | 11/1974 | France . |
| 2421812 | 11/1979 | France . |
| 2213773 | 3/1972 | Germany . |
| 3025751 | 2/1982 | Germany . |
| 61-244757 | 10/1986 | Japan . |
| 62-146162 | 5/1987 | Japan . |
| 1107557 | 7/1989 | Japan . |
| 4215964 | 8/1992 | Japan . |
| 10119999 | 5/1996 | Japan . |
| 9226790 | 9/1997 | Japan . |
| 2034674 | 6/1980 | United Kingdom . |
| 9627532 | 9/1996 | WIPO . |

*Primary Examiner*—Nathan J. Newhouse

[57] ABSTRACT

A tamper-indicating closure of integrally molded plastic construction that include a base wall having a peripheral skirt with internal threads for engaging external threads on a container finish. A tamper-indicating band is connected to the edge of the skirt by a plurality of circumferentially spaced integral frangible bridges. A stop flange extends from an edge of the band remote from the skirt for engagement with a bead on the container finish. The stop flange has a circumferentially continuous free edge remote from the band disposed in a plane parallel to the base wall. A plurality of circumferentially spaced openings are disposed in the stop flange adjacent to the band for drainage of liquid from between the closure skirt and the container finish. A plurality of circumferentially spaced gussets in the stop flange are at the free edge of the ring, with each gusset being disposed between an adjacent pair of drainage openings. The gussets function during inversion of the stop flange, from an axially outward orientation as molded to an axially inward orientation for use, to absorb compressive stresses on the flange and thereby isolate portions of the flange surrounding the drainage openings from such compressive stresses. A plurality of circumferentially spaced lugs are molded on the inside surface of the closure for opposed abutment with the bead on the finish to help facilitate drainage from between the skirt and finish.

34 Claims, 4 Drawing Sheets

U.S. PATENT DOCUMENTS 4,458,821 7/1984 Ostrowsky .
4,458,822 7/1984 Ostrowsky .
4,470,513 9/1984 Ostrowsky .
4,478,343 10/1984 Ostrowsky .
4,506,795 3/1985 Herr .
4,576,298 3/1986 Boik .
4,801,031 1/1989 Barriac .
4,875,594 10/1989 Ochs .
4,895,266 1/1990 Begley .
4,978,016 12/1990 Hayes .
4,981,230 1/1991 Marshall et al. .
5,007,545 4/1991 Imbery, Jr. .
5,058,755 10/1991 Hayes .
5,282,540 2/1994 Beck .
5,400,913 3/1995 Kelly .
5,462,187 10/1995 Gregory et al. .
5,472,106 12/1995 Nofer .
5,488,888 2/1996 Kowal .
5,522,293 6/1996 Ingram .
5,564,319 10/1996 Kowal .
5,570,798 11/1996 Hayashida et al. .
5,650,113 7/1997 Gregory et al. .
5,678,714 10/1997 Guglielmini .
5,685,443 11/1997 Taber et al. ..... 215/252
5,725,115 3/1998 Bösl et al. .
5,727,705 3/1998 Kelly .
5,755,347 5/1998 Ingram .
5,775,527 7/1998 Bösl et al. .
5,947,311 9/1999 Gregory ..... 215/252 X

TAMPER-INDICATING CLOSURE AND METHOD OF MANUFACTURE

The present invention relates to tamper-indicating closures, to methods of manufacturing such closures, and to a package that includes such a closure on a container.

BACKGROUND AND OBJECTS OF THE INVENTION

It is conventional to form a tamper-indicating closure having a band connected to the skirt of the closure by integral frangible bridges. The band has a stop element (e.g., a flange or bead) that engages a bead on the container to resist unthreading of the closure, so that removal of the closure ruptures the frangible bridges that connect the band to the closure skirt. U.S. Pat. No. Re 33,265, assigned to the assignee hereof, discloses a tamper-indicating closure of this character, in which the tamper-indicating band is completely severed from the closure skirt and remains with the container upon removal of the closure from the container. U.S. Pat. No. 5,295,600, also assigned to the assignee hereof, discloses a tamper-indicating closure in which the tamper-indicating band remains connected to the closure skirt and is removed from the container with the closure.

Although tamper-indicating closures of the types disclosed in the noted patents have enjoyed substantial commercial acceptance and success in the art, further improvements remain desirable. In particular, problems are encountered when employing this type of closure with a container in so-called wet finish applications, in which liquid may spill during or after the filling operation onto the outside surface of the container finish so as to be disposed between the container finish and the closure skirt after capping. Wet finish situations of this type are encountered during hot-fill, cold-fill and aseptic-fill situations, in which the containers are filled close to the brim or to overflow prior to capping. Wet finish situations can also be encountered during filling operations in which liquid may drip from the filling machinery onto the container finish. In wet-finish situations of this type, problems are encountered in connection with draining and drying of the area between the outer surface of the container finish and the closure skirt—i.e., between the threads on the container finish and skirt, and around the tamper-indicating band and the stop element. Liquid trapped within this area can result in growth of mold and mildew.

It is a general object of the present invention to provide a closure and method of manufacture that facilitate both drainage of liquid products after capping and improved air flow between the closure and container finish for drying after capping. Another and related object of the present invention is to provide a closure and method of manufacture that achieve the foregoing objectives while retaining the advantages of the closures disclosed in the above-noted patents in terms of ease of application to the container finish after filling (lower top load and lower temperature) and whole or partial rupture of the tamper-indicating band from the closure skirt to provide the tamper-indicating feature. Yet another object of the present invention is to provide a package, which includes a closure and a container, that is particularly well adapted for use in conjunction with wet finish applications as described.

SUMMARY OF THE INVENTION

A tamper-indicating closure of integrally molded plastic construction in accordance with presently preferred embodiments of the invention include a base wall having a peripheral skirt with internal threads for engaging external threads on a container finish. A tamper-indicating band is connected to the edge of the skirt by frangible means such as a plurality of circumferentially spaced integral frangible bridges. A stop flange extends axially outwardly and radially inwardly from an edge of the band remote from the skirt for inversion and engagement with a bead on the container finish. The stop flange has a circumferentially continuous free edge remote from the band disposed in a plane parallel to the base wall. In accordance with one aspect of the present invention, a plurality of circumferentially spaced openings are disposed in the stop flange adjacent to the band for drainage of liquid from between the closure skirt and the container finish. A plurality of circumferentially spaced gussets are disposed in the stop flange at the free edge of the flange, with each gusset being disposed circumferentially between an adjacent pair of drainage openings. The gussets function during inversion of the stop flange, from an axially outward orientation as molded to an axially inward orientation for use, to absorb compressive stresses on the stop flange and thereby isolate portions of the stop flange surrounding the drainage openings from such compressive stresses. The gussets also function following inversion of the stop flange to maintain the geometry of the openings and thereby promote liquid drainage during use.

The inversion relief gussets preferably are on the outer surface of the stop flange (prior to inversion), and are of uniform dimension circumferentially of the stop flange. Thickness of the stop flange between the inversion relief gussets increases from the tamper-indicating band to the free edge of the stop flange, while thickness of the stop flange beneath the gussets is uniform. Thus, the gussets increase in depth radially toward the free edge of the stop flange. In a presently preferred embodiment of the invention, the gussets are in the form of pockets disposed in the outer surface of the stop flange (prior to inversion) opening at the free edge of the stop flange. The dimension of the gussets radially and axially along the surface of the stop flange is about one-half or less of the overall dimension of the stop flange. In a modified embodiment of the invention, the gussets comprise channels that extend axially and radially along the surface of the stop flange between the free edge and the band. The circumferential dimension of each gusset is less than the circumferential spacing between drain openings, and is on the order of one-third of such circumferential dimension.

The drain openings in the stop flange may be of rectangular (including square), semi-circular or triangular configuration. The drain openings are disposed in the stop flange adjacent to the band, and preferably extend partially radially into the band. In accordance with another aspect of the present invention a plurality of circumferentially spaced lugs extend radially inwardly from the closure skirt for opposed radial abutment with the bead on the container finish. The lugs thus space the skirt from the container bead so as to promote drainage of liquid from between the container finish and the closure skirt, and to permit free passage of drying air to the region between the container finish and the closure skirt. This aspect of the invention is useful in connection with closures having a stop element either in the form of a flange as in above-noted U.S. Pat. No. Re 33,265 or in the form of a bead as illustrated in U.S. Pat. Nos. 4,322,009 and 4,432,461, both assigned to the assignee hereof.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
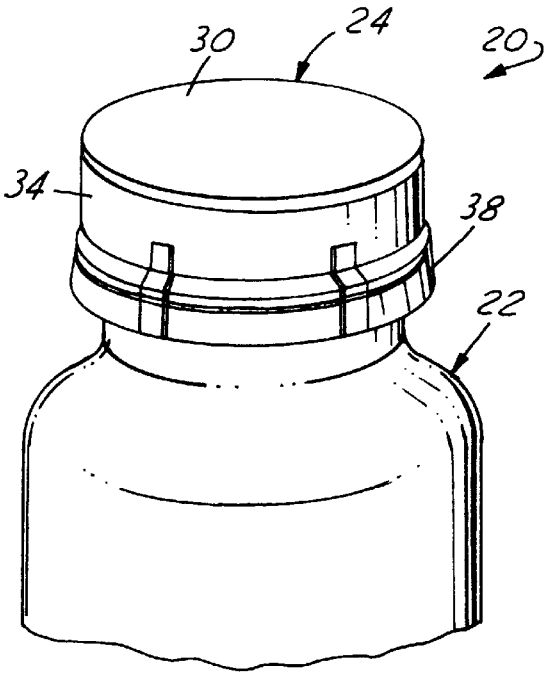
FIG. 1 is a fragmentary perspective view of a container and closure package in accordance with a presently preferred embodiment of the invention.
Figure 2:
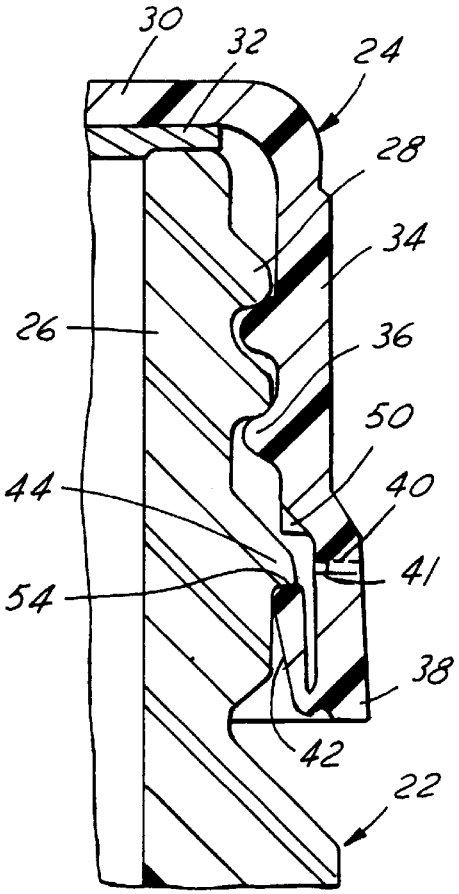
FIG. 2 is a fragmentary sectional view that illustrates the container finish and closure in the package of FIG. 1.
Figure 3:
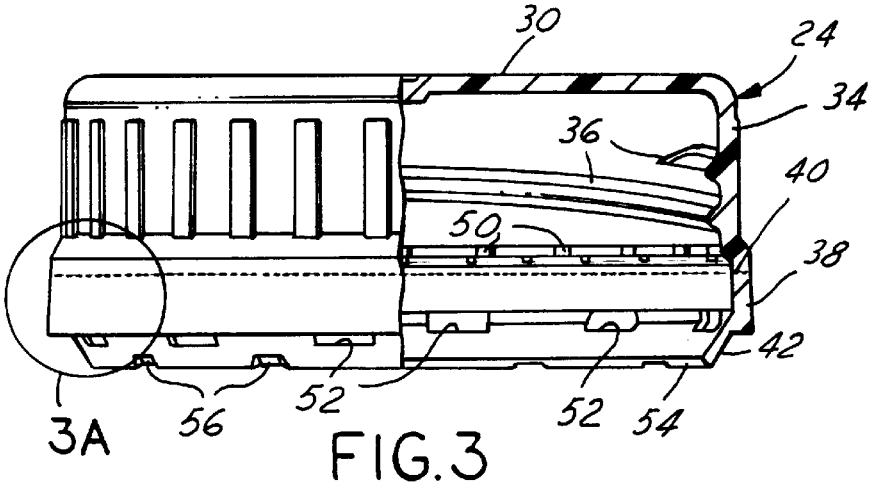
FIG. 3 is a partially sectioned side elevational view of the closure in the package of FIGS. 1 and 2 as molded—i.e., before stop ring inversion.

FIGS. 1–3 illustrate a package 20 in accordance with one presently preferred embodiment of the invention as comprising a container 22 of glass or molded plastic construction and a tamper-indicating closure 24 threaded thereon. Container 22 has an axially extending finish 26 for receiving closure 24. Closure 24 has a flat base wall 30 on which a sealing liner 32 is secured. An annular peripheral skirt 34 extends downwardly from closure base wall 30, and has internal threads 36 for securing closure 24 over external threads 28 of container 22. (Direction adjectives such as "downwardly" are taken with reference to the vertical orientation of the container and closure illustrated in FIGS. 1 and 2.) A tamper-indicating band 38 is secured to the lower end of skirt 34, being separated therefrom by a circumferential score 40. Tamper-indicating band 38 is thus coupled to closure skirt 34 by a circumferentially spaced array of frangible bridges 41 (FIGS. 2 and 3). Bridges 41 preferably are formed during the scoring operation, as described in the patents referenced hereinafter. Alternatively, the bridges may be molded onto the inside surface of skirt 34 and band 38, as shown in U.S. Pat. Nos. 4,407,422 and 4,418,828. Alternatively, but less preferably, band 38 may be connected to skirt 34 by a thin frangible web integrally molded with the closure. A stop flange 42 extends radially inwardly and axially upwardly (FIG. 2) from the lower end of band 38 to a position beneath a radially outwardly extending bead 44 on container 22 beneath threads 28. Bead 44 is sometimes called the container transfer bead or the "A" bead, referring to the fact that bead 44 defines the "A" dimension of the container finish. Stop flange 42 preferably thickens radially inwardly from band 38, being thinnest at the integral juncture with band 38 and thickest at the free edge that abuts the container bead.

Closure 24 may be injection molded as shown or compression molded as taught in U.S. Pat. No. 5,554,327. Liner 32 may be separately formed, or more preferably compression molded in situ within a preformed closure as disclosed in U.S. Pat. Nos. 4,984,703 and 5,451,360. U.S. Pat. Nos. 5,488,888, 5,522,293 and 5,564,319 disclose techniques for forming score 40 and bridges 41 in the scoring operation. U.S. Pat. Nos. 5,755,347 and Re 33,265 disclose techniques for inverting stop flange 42 from the as-molded configuration of FIG. 3 to the configuration of FIG. 2 ready for use. All patents noted herein, assigned to the assignee hereof, are incorporated herein by reference for purposes of background.

Figure 3A:
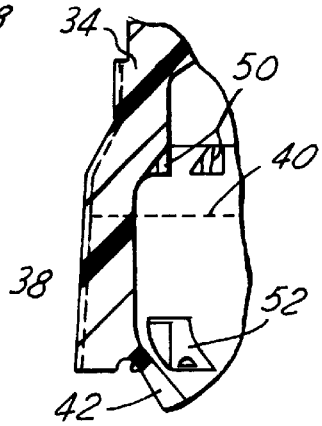
FIG. 3A is a fragmentary sectional view of the portion of the closure within the circle 3A in FIG. 3.
Figure 4:
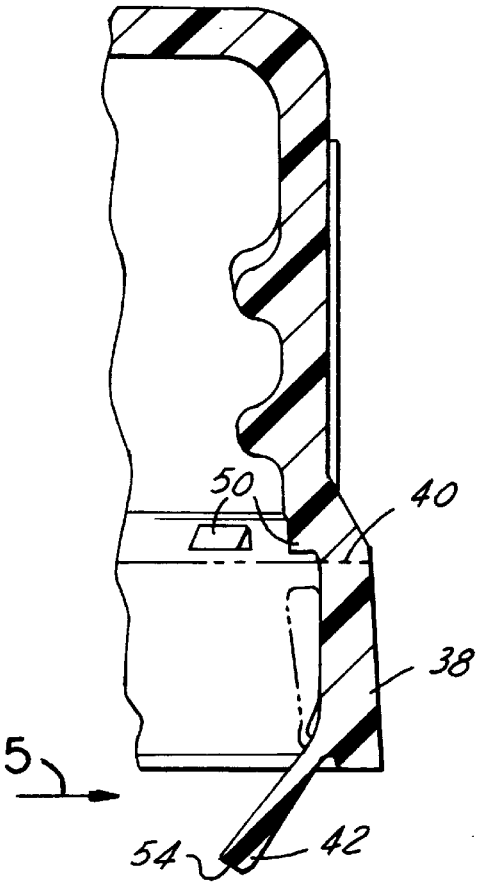
FIG. 4 is a fragmentary sectional view on an enlarged scale of the closure illustrated in FIG. 3.
Figure 5:
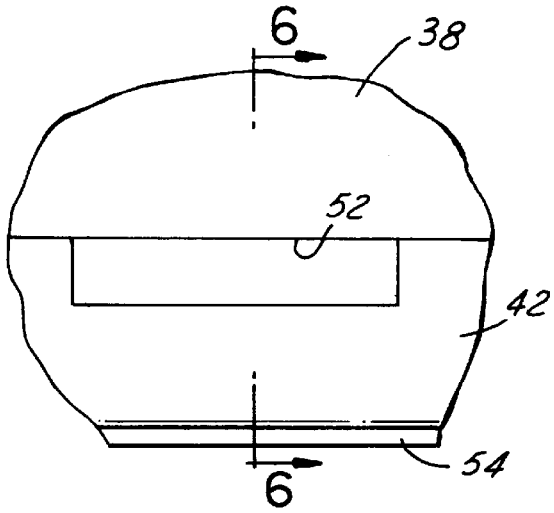
FIG. 5 is a fragmentary elevational view on an enlarged scale of a drain opening in the stop ring of the closure in FIGS. 3 and 4, being taken from the direction 5 in FIG. 4.

FIGS. 3–8 illustrate closure 24 as molded, before inversion of stop flange 42, formation of score line 40 and molding of liner 32. A circumferential array of axially extending lugs 50 are formed on the radially inner surface of skirt 34 during the integral molding operation, and extend radially inwardly from the skirt surface. In the embodiment of FIGS. 3–8, lugs 50 are formed at the conical portion of skirt 34 beneath threads 36 and above band 38 at a position such that the lower ends of lugs 50 are not intersected or cut by score line 40. As best seen in FIG. 3A, lugs 50 effectively form an axial extension of the upper portion of skirt 34, and are disposed for radial abutment with bead 44 on container finish 26 as illustrated in FIG. 2. Thus, lugs 50 ensure that skirt 34 remains radially spaced from bead 44, while the area between the circumferentially spaced lugs remains free for drainage of liquid from between the closure and finish threads, and for ingress of drying air. As an additional feature best seen in FIG. 4, lugs 50 also cooperate with stop ring 42 when the latter is inverted and pressed against the opposing surface of band 38 to form an abutment surface for back-up tooling during formation of score line 40. In a 48 mm closure (standard finish size) in accordance with a presently preferred embodiment of the invention illustrated in FIGS. 1–8, there are twenty-four lugs 50 having centers spaced by 15°. Each lug 50 has a preferred circumferential dimension of 0.060 inches. The spacing between diametrically opposed lug surfaces is −1.889 inches (nominal), as compared with a standard "A" dimension for bead 44 of 48.18 or 48.64 mm. In one presently preferred embodiment of the invention, the circumferential dimension of lugs 50 is greater than the axial dimension of the lugs.

Figure 6:
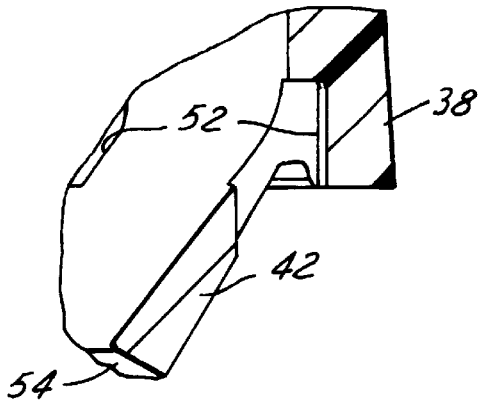
FIG. 6 is a fragmentary sectional view taken substantially along the line 6—6 in FIG. 5.

A circumferential array of drainage openings 52 are formed in stop flange 42 during the molding operation. Drainage openings 52 are disposed immediately adjacent to tamper-indicating band 38, and preferably extend radially into the inner surface of band 38, as best seen in FIG. 6. The opening edge walls in flange 42 and band 38 are axially oriented and parallel to each other due to the axial orientation of the mold tooling that forms the openings. Openings 52 are entirely bounded by flange 42 and band 38. That is, drainage openings 52 do not extend to the free edge 54 of stop flange 42 remote from band 38. Rather, stop flange free edge 54 is circumferentially continuous and disposed in a plane parallel to the plane of closure base wall 30 both prior to inversion (FIGS. 3–8) and after inversion (FIG. 2). In the 48 mm embodiment of the invention illustrated in FIGS. 1–8, drain openings 52 are rectangular, having a radial dimension of 0.0452 inches and a circumferential dimension of 0.183 inches. Openings 52 extend 0.022 inches into band 38, which has a lower end thickness of 0.042 inches. The total radial and axial length of flange 42, measured from band 38, is 0161 inches. The thickness of flange 42 adjacent to band 38 is 0.013 to 0.015 inches, and the thickness at the free edge of the band is 0.035 inches.

Figure 7:
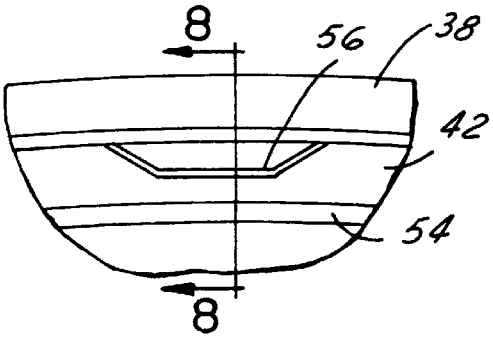
FIG. 7 is a fragmentary bottom plan view of the closure illustrated in FIGS. 3–6 featuring illustration of an inversion relief gusset, being taken from the direction 7 in FIG. 3.
Figure 8:
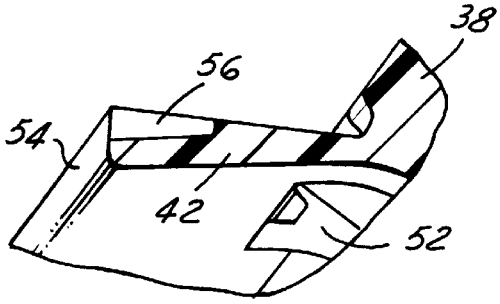
FIG. 8 is a fragmentary sectional view taken substantially along the line 8—8 in FIG. 7.

A circumferential array of inversion relief gussets 56 are disposed around the outer surface of stop flange 42. Each gusset 56 is disposed circumferentially midway between an adjacent pair of drainage openings 52. The thickness of stop flange 42 between inversion relief gussets 56 increases between band 38 and free edge 54 as previously described. However, as best seen in FIGS. 7 and 8, the thickness of stop flange 42 beneath each gusset 56 is substantially uniform throughout the length and width of the gusset, which is to say that the depth of gusset 56 increases to free edge 54. When molding closure 24, the plastic material must flow around the mold inserts that form drainage opening 52. This material flow forms a knit line or area in stop flange 42 beneath each drainage opening 52, which is an area of weakness at which stop flange 42 can fracture during inversion of the stop flange. The purpose of gussets 56 is to form weakened areas in the thinner portions of stop flange 42 formed by the gussets, which distort during inversion due to the compressive stresses applied to the stop flange, and thereby isolate such compressive stresses from the areas surrounding the drainage openings. Inversion relief gussets 56 thus help prevent cracking of the stop ring beneath the drainage openings during inversion. Furthermore, the inversion relief gussets prevent kinking of the stop flange at the drainage openings following inversion, thereby ensuring that the full areas of the openings are available for liquid drainage during use. In the embodiment of the invention illustrated in FIGS. 1–8, gussets 56 comprise pockets formed in the outer surface of flange 42 at free edge 54 (i.e., opening into the free edge) and spaced from the band 38. In the illustrated embodiment of the invention, there are twelve equally spaced drainage openings 52, and twelve equally spaced inversion relief gussets 56 disposed around stop flange 42. Gussets 56 have a circumferential dimensions of 0.060 inches at the base of each gusset, opening outwardly from the base at an angle of 60°. (All exemplary dimensions in the application are nominal.) The radial/axial dimension of each gusset along the surface of the flange is 0.062 inches. The circumferential dimension of each gusset (0.060 inches) is thus substantially less than the circumferential dimension between openings 52 (about 0.33 inches). It is preferable that drainage openings 52 occupy as much area as possible without weakening stop flange 42. Inversion relief gussets 56 help prevent cracking at openings 52 as described, and help maintain circularity of stop flange 42 after inversion.

Figure 9:
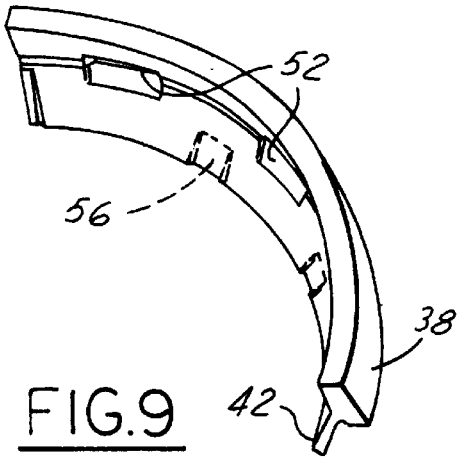
FIGS. 9, 10, 11, 12, 13 and 14 are fragmentary perspective views of the closure tamper-indicating band and stop ring in accordance with respective preferred embodiments of the invention.
Figure 10:
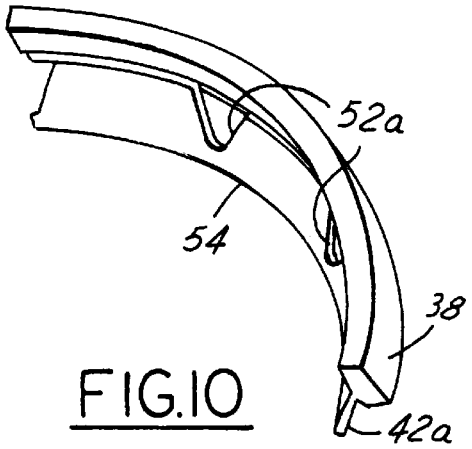
Figure 11:
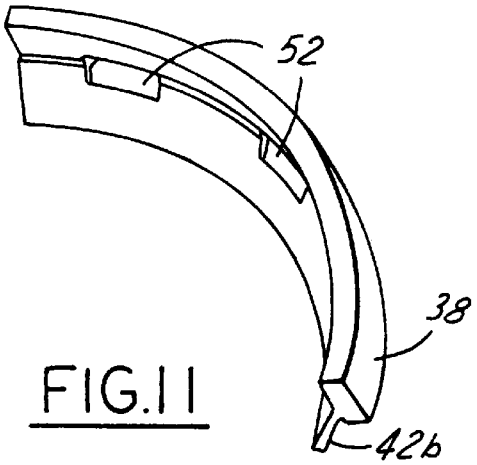
Figure 12:
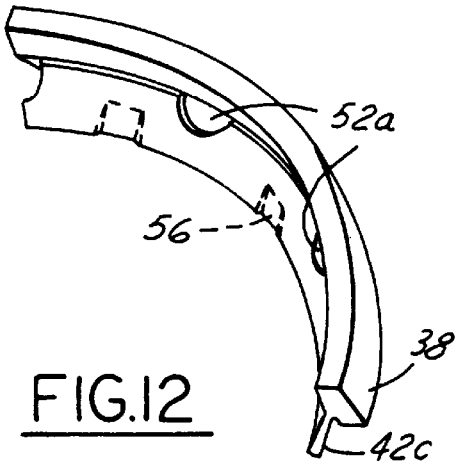
Figure 13:
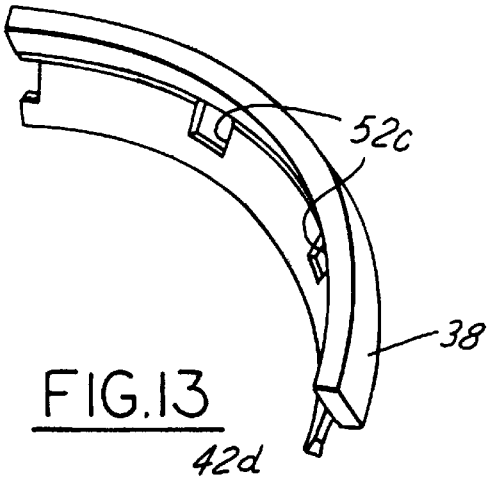
Figure 14:
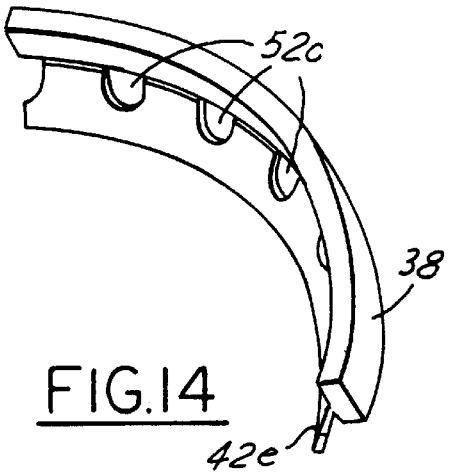

FIG. 9 illustrates tamper-indicating band 38 and stop flange 42 in accordance with the preferred embodiment hereinabove described, including rectangular drain openings 52 and inversion relief gussets 56. FIGS. 10–14 illustrate associated modified embodiments of the invention. In FIG. 10, the stop flange 42*a* includes triangular drainage openings 52*a* and no inversion relief gussets. It is believed that more uniform material flow can be obtained during the molding operation employing triangular drainage openings 52*a,* so that the knit-line areas of weakness formed at the apex of each opening adjacent to stop flange edge 54 will be less pronounced, and inversion relief gussets are not needed. In an exemplary 48 mm embodiment according to FIG. 10, there were twelve equally spaced drainage openings 52*a,* each having a radial dimension of 0.062 inches (as compared with an overall stop flange radial dimension of 0.156 inches), and side edges at angles of 45° to the radius. FIG. 11 illustrates a stop flange 42*b* having rectangular drainage opening 52 but no inversion relief gussets. FIG. 12 illustrates a stop flange 42*c* having semi-circular drainage openings 52*c,* each with a straight or diametric dimension oriented circumferentially of the stop flange and a semi-circular edge extending into the stop flange. An inversion relief gusset 56 is positioned between each adjacent pair of semi-circular drainage openings 52*c*. FIG. 13 illustrates an embodiment in which stop flange 42*d* has square drainage openings 52*c* and no inversion relief gussets. FIG. 14 illustrates an embodiment in which the stop flange 42*e* includes semi-circular drainage openings 52*c,* again with no inversion relief gussets. It is believed that plastic material will flow more evenly and uniformly around the semi-circular edges of the mold plugs that form openings 52*c,* reducing or eliminating the knit-line weakness between each drainage opening and the free edge 54 of the stop flange, so that inversion relief gussets 56 may not be required to prevent cracking of the stop flange beneath the drainage openings in these embodiments.

Figure 15:
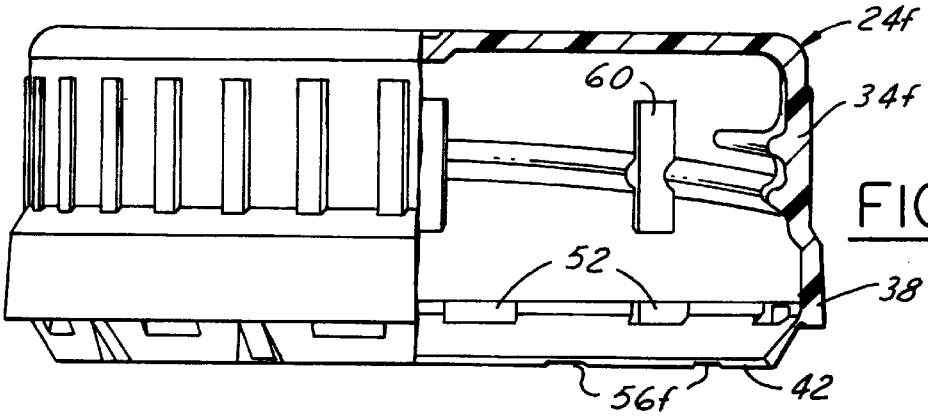
FIG. 15 is a partially sectioned elevational view similar to that of FIG. 3 but showing a modified embodiment of the invention.
Figure 15A:
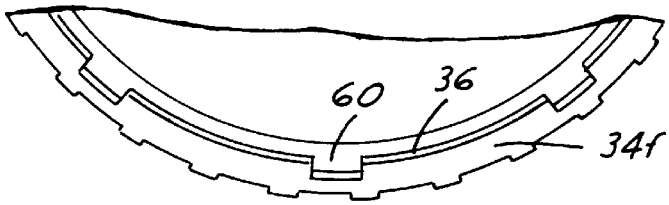
FIG. 15A is a fragmentary bottom plan view of the closure illustrated in FIG. 15.
Figure 15B:
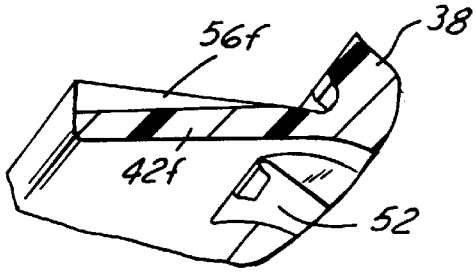
FIG. 15B is a fragmentary sectional view similar to that of FIG. 8 but illustrating the embodiment of FIGS. 15 and 15A.

FIGS. 15, 15A and 15B illustrate a modified closure 24*f* in accordance with the present invention. Closure 24*f* is basically the same as closure 24 described above, with the exception that drainage slots 60 are provided on the inside diameter of skirt 34*f,* and the inversion relief gussets are in the form of channels 56*f*. Each slot 60 is of rectangular geometry, having a long dimension extending axially along the inside surface of the skirt through the container threads. The radial or depth dimension of slots 60, as best seen in FIG. 15A, is greater than the thickness of threads 36, so that each drainage slot 60 extends radially into the body of skirt 34*f*. The purpose of slots 60 is to promote drainage of liquid past the container and closure threads to a position within band 38 adjacent to stop flange 42, from which the liquid drains through openings 52. Slots 60 also promote circulation of drying air in the region of the container and closure threads between the container finish and the closure skirt. In an exemplary, 48 mm embodiment 24*f,* there are nine equally spaced slots 60, each having a circumferential dimension of 0.125 inches. The radial dimension of the slots is 0.010 inches greater than the radius of the inside wall or "T" wall of the closure. Gusset slots 56*f* extend axially and radially along the surface of flange 42*f* from band 38 to the free edge of the band.

Figure 16:
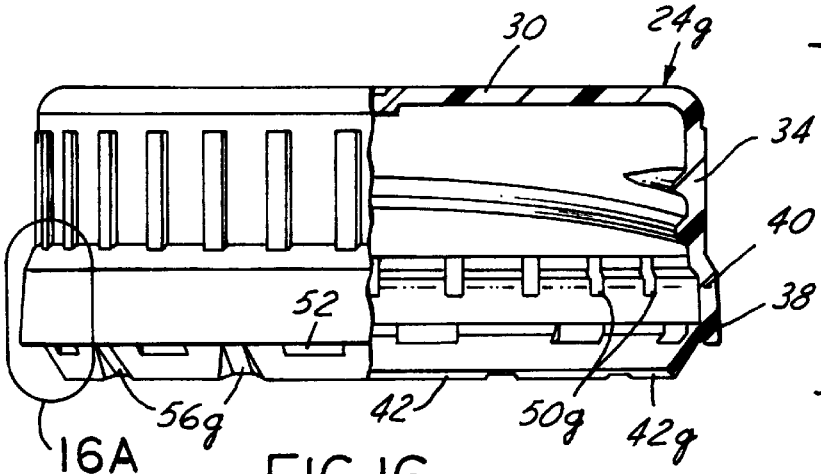
FIG. 16 is a partially sectioned elevational view similar to those of FIGS. 3 and 15 but showing another modified embodiment of the invention.
Figure 16A:
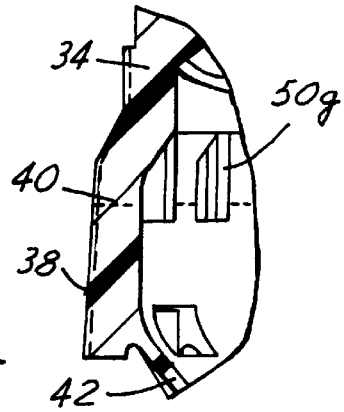
FIG. 16A is a view, similar to that of FIG. 3A, showing the portion of the closure in FIG. 16 within the circle 16A.

FIGS. 16 and 16A illustrate a closure 24*g* that is basically the same as closure 24 in FIGS. 1–8, except that lugs 50*g* are axially elongated so as to function not only as spacer lugs with respect to container bead 44, but also as the frangible bridges that couple band 38 to skirt 34. That is, lugs 50*g* are integrally molded on the inside surface of skirt 34 and band 38 as in prior embodiments, and are of elongated axial dimension as compared with prior embodiments so as to extend through the plane of score line 40. In this way, when the skirt is scored to form score line 40, which separates skirt 34 from band 38, the score intersects but does not fully penetrate lugs 50*g*. Lugs 50*g* thus serve as the frangible bridges that connect skirt 34 to band 38, and a two-stage scoring operation is not required.

What is claimed is:

1. A tamper-indicating closure of integrally molded plastic construction, which comprises:

a base wall having a peripheral skirt with internal threads for engaging external threads on a container finish, a tamper-indicating band connected by frangible means to an edge of said skirt, and a stop flange extending axially outwardly and radially inwardly from an edge of said band remote from said skirt, said stop flange having a circumferentially continuous free edge remote from said band disposed in a plane parallel to said base wall, a plurality of circumferentially spaced openings adjacent to said band, and a plurality of circumferentially spaced gussets, each of said gussets being disposed circumferentially between an adjacent pair of said openings, said gussets functioning during inversion of said stop flange, from an axially outward orientation as molded to an axially inward orientation for use, to absorb compressive stresses on said stop flange and thereby isolate portions of said stop flange surrounding said openings from said compressive stresses.

2. The closure set forth in claim 1 wherein said gussets are on an outer surface of said stop flange prior to inversion of said stop flange.

3. The closure set forth in claim 2 wherein said gussets are of identical geometry.

4. The closure set forth in claim 3 wherein said gussets are of uniform dimension circumferentially of said stop flange.

5. The closure set forth in claim 4 wherein thickness of said stop flange between said gussets increases from said band to said free edge, and wherein thickness of said stop flange is uniform at said gussets as depth of said gussets increases toward said free edge.

6. The closure set forth in claim 5 wherein said gussets comprise pockets in said outer surface of said flange adjacent to said free edge and spaced from said band.

7. The closure set forth in claim 5 wherein said gussets comprise channels that extend along said outer surface from said free edge to said band.

8. The closure set forth in claim 1 wherein said openings are rectangular.

9. The closure set forth in claim 8 wherein said rectangular openings are square.

10. The closure set forth in claim 8 wherein said rectangular openings are non-square, having a long edge dimension extending circumferentially of said flange and a short edge dimension extending radially of said flange.

11. The closure set forth in claim 1 wherein said openings are semi-circular, having a diametric edge extending circumferentially of said stop flange.

12. The closure set forth in claim 1 wherein said openings are triangular, having one straight edge extending circumferentially of said stop flange.

13. The closure set forth in claim 1 for mounting on a container having a circumferential bead for engagement by said stop flange, wherein said closure further includes a plurality of circumferentially spaced lugs extending radially inwardly from said skirt at a position to be disposed radially outwardly of said bead to space said skirt from said bead.

14. The closure set forth in claim 13 wherein said lugs are integrally molded onto an inside surface of said skirt.

15. The closure set forth in claim 14 wherein said frangible means comprises a plurality of circumferentially spaced frangible bridges formed by said lugs.

16. The closure set forth in claim 1 further including a plurality of circumferentially spaced drain slots in said skirt that extend axially through said internal threads.

17. The closure set forth in claim 16 wherein said drain slots have a radial depth greater than that of said internal threads.

18. A tamper-indicating closure of integrally molded plastic construction, which comprises:

a base wall having a peripheral skirt with internal threads for engaging external threads on a container finish, a tamper-indicating band connected to an edge of said skirt by a plurality of circumferentially spaced frangible bridges, and a stop flange extending from an edge of said band remote from said skirt, said stop flange having a circumferentially continuous free edge remote from said band disposed in a plane parallel to said base wall, and a plurality of circumferentially spaced gussets formed in an outer surface of said stop flange adjacent to said free edge, said gussets functioning during inversion of said stop flange, from an axially outward orientation as molded to an axially inward orientation for use, to absorb compression stresses on said stop flange.

19. The closure set forth in claim 18 wherein said stop flange further includes a plurality of circumferentially spaced openings, said gussets functioning during inversion of said stop ring to isolate portions of said stop flange surrounding said openings from said compressive stresses.

20. The closure set forth in claim 18 wherein said gussets comprise pockets in said outer surface of said flange adjacent to said free edge and spaced from said band.

21. The closure set forth in claim 18 wherein said gussets comprise channels that extend along said outer surface from said free edge to said band.

22. The closure set forth in claim 18 for mounting on a container having a circumferential bead for engagement by said stop flange, wherein said closure further includes a plurality of circumferentially spaced lugs extending radially inwardly from said skirt at a position to be disposed radially outwardly of said bead to space said skirt from said bead.

23. The closure set forth in claim 22 wherein said lugs are integrally molded onto an inside surface of said skirt.

24. The closure set forth in claim 23 wherein said frangible bridges are formed by said lugs.

25. A package that comprises a container having a finish with external threads and an external bead disposed beneath said finish, and a tamper-indicating closure of integrally molded plastic construction that includes:

a base wall having a peripheral skirt with internal threads for engaging external threads on a container finish, a tamper-indicating band connected by frangible means to an edge of said skirt, and a stop flange extending axially and radially inwardly from an edge of said band remote from said skirt to a position adjacent to said bead, said stop flange having a circumferentially continuous free edge remote from said band disposed in a plane parallel to said base wall, a plurality of circumferentially spaced openings adjacent to said band, and a plurality of circumferentially spaced gussets, each of said gussets being disposed circumferentially between an adjacent pair of said openings, said gussets functioning during inversion of said stop flange, from an axially outward orientation as molded to an axially inward orientation for use, to absorb compressive stresses on said stop flange and thereby isolate portions of said stop flange surrounding said openings from said compressive stresses.

26. The package set forth in claim 25 wherein said closure further includes a plurality of circumferentially spaced lugs extending radially inwardly from said skirt at a position to be disposed radially outwardly of said bead to space said skirt from said bead.

27. The package set forth in claim 26 wherein said lugs are integrally molded onto an inside surface of said skirt.

28. The package set forth in claim 27 wherein said frangible means comprises a plurality of circumferentially spaced frangible bridges formed by said lugs.

29. The package set forth in claim 27 further including a circumferential score line forming said frangible bridges, wherein said score line does not intersect said lugs.

30. The package set forth in claim 27 wherein said gussets comprise pockets in said outer surface of said flange adjacent to said free edge and spaced from said band.

31. The package set forth in claim 27 wherein said gussets comprise channels that extend along said outer surface from said free edge to said band.

32. A method of forming an integrally molded plastic tamper-indicating closure for a container having a finish with external threads and an external bead, said method comprising the steps of:

(a) forming a base wall having a peripheral skirt with internal threads for engaging external threads on a container finish, (b) forming a tamper-indicating band connected to an edge of said skirt by a plurality of circumferentially spaced integral frangible bridges, (c) forming a stop flange extending from an edge of said band remote from said skirt, said stop flange having a circumferentially continuous free edge remote from said band disposed in a plane parallel to said base wall, a plurality of circumferentially spaced openings, and a plurality of circumferentially spaced gussets, each disposed between an adjacent pair of said openings, and (d) inverting said stop flange, during which said gussets function to absorb compressive stresses on said flange and isolate portions of said stop flange surrounding said openings from said compressive stresses.

33. The method set forth in claim 32 comprising the additional step of:

(e) forming a plurality of circumferentially spaced lugs extending radially inwardly from said skirt at a position to be disposed radially outwardly of said bead to space said skirt from said bead.

34. A method of forming a tamper-indicating closure for a container having a finish with external threads and an external bead, said method comprising the steps of:

(a) integrally molding a one-piece plastic tamper-indicating closure that includes a base wall having a peripheral skirt with internal threads for engaging external threads on a container finish, a tamper-indicating band connected to an edge of said skirt by a plurality of circumferentially spaced integral frangible bridges, and a stop flange extending from an edge of said band remote from said skirt, said stop flange having a circumferentially continuous free edge remote from said band disposed in a plane parallel to said base wall, and a plurality of circumferentially spaced gussets extending to a free edge of said flange, and (b) inverting said stop flange, during which said gussets function to absorb compressive stresses on said flange.

* * * * *